US005129331A

United States Patent [19]

Merritt et al.

[11] Patent Number: 5,129,331

[45] Date of Patent: Jul. 14, 1992

[54] EMISSIONLESS FURNACE BOILER SYSTEM

[76] Inventors: Thomas D. Merritt, P.O. Box 380016, Miami, Fla. 33238; Alexander Blake, 4 Walnut Hollow La., Holmdel, N.J. 07733

[21] Appl. No.: 594,816

[22] Filed: Oct. 9, 1990

Related U.S. Application Data

[63] Continuation-in-part of Ser. No. 481,959, Feb. 20, 1990, Pat. No. 5,027,720, which is a continuation-in-part of Ser. No. 255,960, Oct. 11, 1988, Pat. No. 4,903,499, which is a continuation-in-part of Ser. No. 182,528, Apr. 18, 1988, abandoned, which is a continuation-in-part of Ser. No. 141,811, Jan. 11, 1988, abandoned.

[51] Int. Cl.[5] ..... F23J 15/00

[52] U.S. Cl. ..... 110/203; 55/23; 55/57; 55/80; 55/269; 110/216; 110/345; 122/20 B

[58] Field of Search ..... 55/23, 57, 80, 269, 55/421; 122/20 B; 110/203, 216, 233, 234, 345

[56] References Cited

U.S. PATENT DOCUMENTS 4,531,951 7/1985 Burt et al. ..... 55/23
4,539,817 9/1985 Staggs et al. ..... 42/149
4,660,511 4/1987 Anderson ..... 122/20 B
4,681,612 7/1987 O'Brien et al. ..... 55/23 X

*Primary Examiner*—Edward G. Favors
*Attorney, Agent, or Firm*—M. K. Silverman

[57] ABSTRACT

An apparatus for separating and recovering effluent gases from a furnace includes a pressure vessel for containing the gases. This vessel has a fluid input for receiving the gases and a fluid output for selectively removing the gases when they are separated. A condenser is provided to transform and maintain the lowest vapor pressure gas as a liquid so that it accumulates as a liquid at the bottom of the vessel. The remaining non-condensed effluent gases accumulate in strata above the liquid. Apparatus is provided to selectively remove the liquid and at least one of the remaining non-condensed gases from the vessel through the fluid output. Also set forth is a method for recovering effluent gases from a furnace including the steps of adding the gases to a pressure vessel, altering the density of the gases so that the lowest vapor pressure gas condenses into a liquid and the non-condensed gases stratify above the liquid. Then the liquid is removed from vessel and optionally expanded to cool the vessel. Finally, at least one stratified non-condensed gas is selectively removed from the vessel.

34 Claims, 6 Drawing Sheets

EMISSIONLESS FURNACE BOILER SYSTEM

REFERENCE TO RELATED APPLICATION

This is a continuation-in-part of application Ser. No. 07/481,959 filed Feb. 20, 1990, U.S. Pat. No. 5,027,720 entitled Emissionless Furnace Boiler System which was a continuation-in-part of Ser. No. 07/255,960, filed Oct. 11, 1988, now U.S. Pat. No. 4,903,499 assigned to High Frequency Products, Inc., which in turn was a continuation-in-part of Ser. No. 182,528 filed Apr. 18, 1988now abandoned, which in turn was a continuation-in-part of Ser. No. 141,811 filed Jan. 11, 1988, now abandoned.

BACKGROUND OF THE INVENTION

In recent years, considerable concern has grown with regard to the phenomenon known as acid rain. Acid rain is caused by the condensation of gases such as sulphur dioxide and nitrous oxide which are emitted into the atmosphere during the burning of sulphur-containing fossil fuels such as coal. See *The Acid Rain Source Book* by Elliott and Schwieger for a thorough explanation of this phenomenon. The burning of sulphur-containing coal typically occurs during the production of electricity as fossil fuels are burned to produce heat to, in turn, produce steam which is employed to effect the turning of a turbine in production of electricity.

In addition, the burning of fossil fuels produces other harmful effluents including carbon dioxide, carbon monoxide, and nitrous oxide. These effluents have been deemed to be unsafe for human intake and are believed to be the source of another adverse environmental phenomenon known as the greenhouse effect, a result of which is global warming.

Accordingly, it is to be appreciated that the burning of fossil fuels in the production of electricity and in other industrial processes is believed to be a primary source of two of the most environmentally threatening phenomena of the day, namely, acid rain and the greenhouse effect.

In order to avoid resort to nuclear sources in achieving levels of production of electricity that are necessary to sustain industrial and other needs, it has long been recognized that the capture of noxious emissions of effluent gases is a requirement for environmental and human safety. Most approaches to the problem of effluent emissions known the prior art consist of the treatment of the discharged gases with absorbents, catalysts, and other such chemical and mechanical approaches for the removal and/or conversion of the gaseous effluents. These prior art efforts have proven to be expensive and cumbersome to implement and, as such, have not enjoyed widespread acceptance except in those areas where the strictest governmental enforcement occurs. Therefore, a need has long existed for a cost-effective means of control of effluent gases from industrial processes.

The present invention provides an emissionless furnace apparatus and method that not only captures effluent gas emissions but, in addition, separates and recycles most of these emissions to thereby further diminish the cost of implementation of the inventive system.

SUMMARY OF THE INVENTION

The instant invention relates to an emissionless furnace effluent gas recovery apparatus and method for the extraction of a plurality of processed effluent gases that would normally be discharged at the output of an industrial process, such as the burning of fossil fuel in the generation of electricity.

The apparatus more particularly includes a pressure vessel for containing said gases, having fluid input means for receiving said gases, and having fluid output means; condensing means to transform and maintain as a liquid the lowest vapor pressure gas so that the lowest vapor pressure gas condenses and accumulates as a liquid at the bottom of said vessel and the remaining condensed and non-condense effluent gases accumulates in strata above said liquid; means to remove said liquid from said vessel, through said fluid output means, and a means to selectively remove at least one of the remaining non-condensed effluent gases from said vessel through said fluid output means.

Alternate condensing means can be used to transform and maintain as a liquid the lowest vapor pressure gas. A mechanical means involves a placing of the pressure vessel in thermal communication with a contained and condensing gas whose expansion lowers the temperature of the pressure vessel. Lowering the temperature of the vessel aids in condensation the remaining gases. The condensing means is used to transform and maintain as a liquid the lowest vapor pressure gas so that the lowest vapor pressure gas condenses in and accumulates as a liquid at the bottom of said vessel and the remaining condensed and non-condensed effluent gas accumulates in strata according to their vapor pressures.

Alternatively, the condensing means can involve use of a hollow, annular jacket having a surface thereof in thermal communication with said pressure vessel, said jacket preferably having an axis in substantial alignment with the direction of gravitational force and further including refrigerant fluid input and output means. Further alternative is to provide refrigerant-carrying tubes extending around or throughout the pressure vessel, the surfaces of which are in thermal communication with the pressure vessel. The thermal communication can be achieved in a variety of ways including but not limited to the use of means for fluid communication.

The system can also include a fluid path beginning internally of said pressure vessel, passing through said vessel, through said fluid output means thereof, continuing externally of said vessel, and extending between said vessel and said input means to said jacket or said tubes. Within said fluid path, but prior to said input means of said jacket or tubes, there is provided variable expansion means for selectively modifying the volume of fluid flowing from said vessel prior to its entry into said jacket. The condensing means can further include compression means having an input in fluid communication with said output of said annular jacket or said tubes, said compression means itself having an output in fluid communication with said input means of said pressure vessel.

This invention also includes the method for recovering effluent gases from a furnace comprising the steps of adding said gases to a pressure vessel, altering the density of the gases so that the lowest vapor pressure gas condenses within said vessel to a liquid and the remaining condensed and non-condensed gases stratify above the liquid; removing said liquid from said vessel and selectively removing at least one stratified non-condensed gas remaining in said vessel through an outlet of said vessel. The density of the gases is altered by altering their pressure, their temperature, or both their pressure and temperature. The invention also can further include evaporating a portion of the liquid to cool the vessel and its contents and releasing some of the heat from the fluid mixture by means of a heat exchanger. The evaporation can be accomplished by altering the pressure of the effluent gases prior to the entry into the pressure vessel.

It is an object of the present invention to provide an emissionless furnace apparatus and method.

It is another object of the present invention to provide an effluent gas recovery apparatus and method in which gases from an effluent gas output, of an industrial process, may be liquified without escape into the atmosphere.

It is a further object to provide an apparatus and method of the above type in which other effluent gases having a lower boiling point at a given pressure will occupy, in gaseous or liquid form, strata within a pressure vessel, above said liquefied effluent, such that stratified effluent gases may be separately removed from the system.

It is a yet further object of the invention to recycle selective effluent gases to contribute to industrial burning processes.

It is a still object of the invention to make selective use of separated, stratified effluent gases for re-use in non-burning industrial processes.

It is a yet further object of the invention to provide an apparatus for use with a furnace and effluent gas discharge thereof, which will permit liquefication and recovery of the constituent gases comprising the gas discharge of an industrial process.

The above and yet other objects and advantages of the present invention will become apparent from the hereinafter set forth Detailed Description of the Invention, The Drawings and Claims appended herewith.

DETAILED DESCRIPTION OF THE INVENTION

Figure 1:
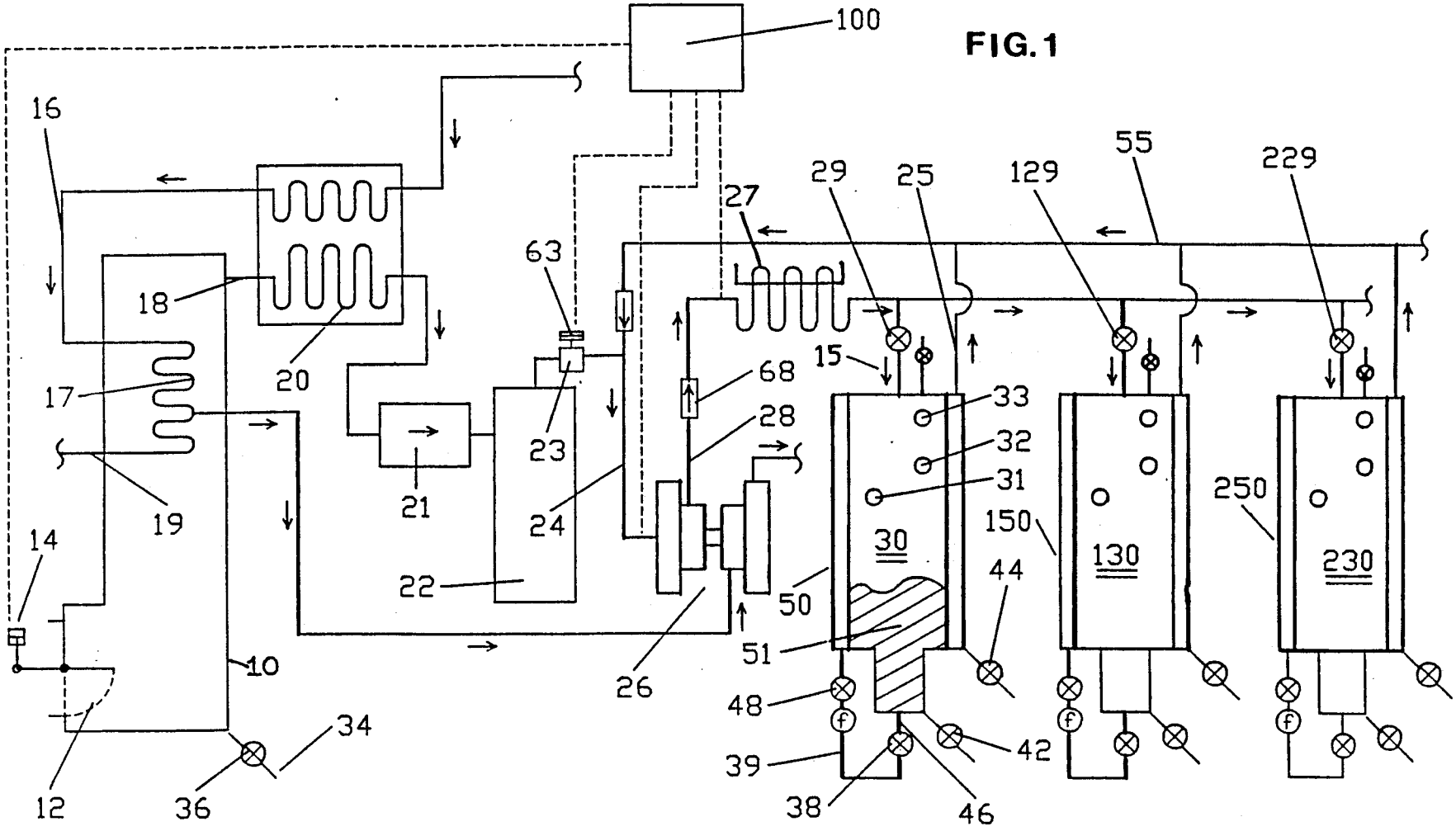
FIG. 1 is a schematic representation of the inventive emissionless furnace apparatus.

With reference to FIG. 1, the present invention comprises an apparatus and method for separating and recovering effluent gases from a furnace 10. The apparatus comprises a pressure vessel 30 for containing these gases. This vessel 30 has fluid input 15 for receiving said gases and a plurality of fluid outputs 31, 32, 33 and 46 for selectively removing them after they are separated. The apparatus also comprises condensing means to transform and maintain as a liquid the lowest vapor pressure gas so that said lowest vapor pressure gas condenses and accumulates as a liquid 51 at the bottom of said vessel 30. The remaining non-condensed and condensed effluent gases accumulate in strata above the liquid 51. The liquid and stratified gases are then selectively removed through said outputs 31, 32, 33 and 46.

The condensing means preferably comprises means to alter the temperature and pressure of the contained effluent gases to the point of liquefication of at least the lowest vapor pressure gas. Preferably the volume of liquefied gas can be expanded to cool the contained gases, thus serving as part of the condensing means.

By way of explanation, it is noted that the lowest vapor pressure gas is also the highest boiling point gas, which is also the lowest entropy gas. The lowest entropy gas is the gas having the highest degree of order at a given temperature and pressure—and thus the gas which condenses first. A more common way of identifying the gas which condenses first would be to say that it is the gas having the lowest vapor pressure or the highest boiling point. The gas with the lowest vapor pressure will liquefy first as the temperature of the gas/-liquid mixture is lowered. In other words, the gas with the highest boiling point will liquefy first as the pressure of the gas mixture is increased.

Figure 3:
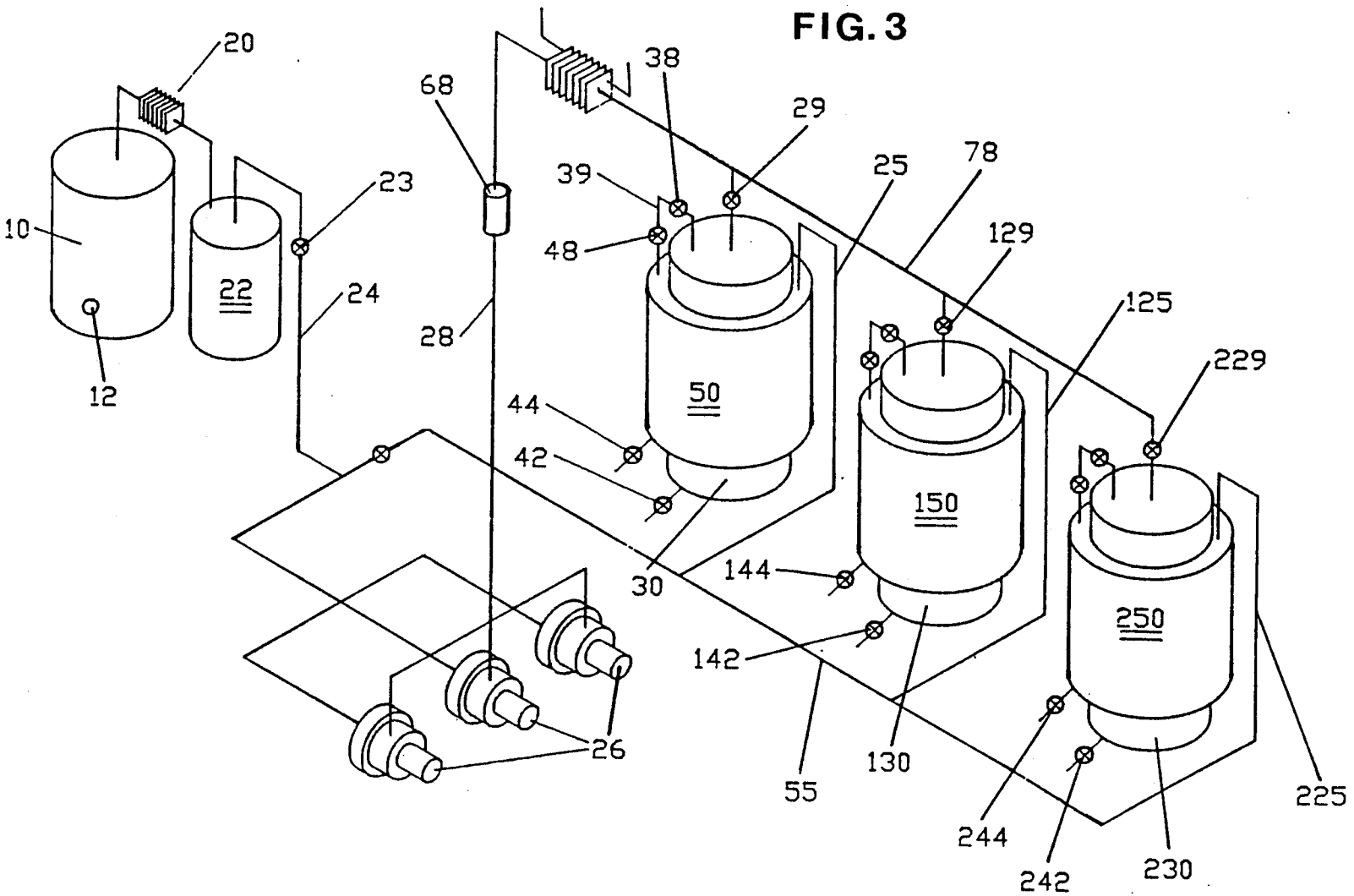
FIG. 3 is a schematic view of an embodiment depicting the use of multiple compressors.

With reference to FIGS. 1 and 3, a fossil fuel fired furnace 10 is provided with means for air entry 12 and a related air controller 14.

In the preferred embodiment, effluent gases exit the furnace 10 through flue 18, through heat exchanger 20, which is an element of the condensing means, where the residual heat of the gases is removed. A heat exchanger is commonly known as an economizer. From the heat exchanger 20, the gases are optionally passed through an electro-static precipitator 21 of the type used in conventional furnaces. In precipitator 21 all particulate matter such as dust, ash, and soot is removed.

From precipitator 21, the gases are drawn into a low pressure accumulator 22 adapted to remove any remaining particulate matter. In this area, any particles which may have escaped precipitator 21 are filtered out. From the accumulator 22, low pressure gases pass through a damper 23 which has an associated controller 63, through conduit 24 and into gas compression means 26. These compression means are another element of said condensing means. Then the compressed gases flow through high pressure conduit 28 and through condenser 27, which is a second heat exchanger.

Damper controller 63 is in feedback communication with air entry controller 14. The purpose of this feedback relationship is to maintain a sufficient steady entrance pressure at the compression means 26 and a designated oxygen content for the furnaces to operate properly. This feedback relationship is accomplished by controller 100. The oxygen content of the furnace is controlled by the volume of air permitted to enter the furnace 10. The volume, velocity and pressure of processed flue gases reaching conduit 24 is a function of the amount of air originally forced or drawn into furnace 10 at air entry means 12. Accordingly, electrical or pneumatic feedback communication between controller 14 of air entry means 12 and damper controller 63 assures that a sufficient quantity of treated flue gas, at a desired pressure level, will be available to the compression means 26. Any conventional compression means can be used. The preferred compression means is a centrifugal compressor. Alternatively, multiple compressors can be used and staged, according to the local demand.

The accumulator 22 helps deliver the gas to compressor 26 in a steady flow. From accumulator 22, the treated effluent gases are drawn into compressor 26 where they are compressed to a pressure generally above ambient. These compressed gases then advance through high pressure conduit 28, through one way valve 68, through control valve 29, and into pressure vessel 30.

The compressor 26 maintains, in said conduit 28 and vessel 30, a sufficient pressure above ambient pressure at the temperatures employed to condense the highest boiling point gas, typically, sulphur dioxide. A constant desired pressure can be maintained by placing a suitable release valve in the conduit 28 or vessel 30. Gases exiting through this valve are carried through a return conduit to accumulator 22. Alternatively, the compressor 26 gradually increases the pressure in said conduit 28 gradually and vessel 30 until said gas condenses.

The pressure required for said condensation is a function of the temperature of the gases, and is usually around 150 pounds per square inch gauge ("psig"). The temperature of the gases may be lowered to a constant value and held at that value, or lowered until condensation takes place, as set forth below.

As the lowest vapor pressure gas, e.g. sulphur dioxide, condenses within vessel 30, it accumulates in liquid form 51 at the bottom of vessel 30. The liquid sulphur dioxide may be drained from vessel 30 through valve 42 and into a storage container. Some liquid sulphur dioxide is preferably passed through a fluid path where it expands into gas and cools the vessel.

In the first instance, where the sulphur dioxide is not placed in a fluid path to cool the vessel 30, the vessel is cooled by other means. Such means may include any of several self-contained refrigeration system known in the art. The second and preferred apparatus provides a fluid path for the sulphur dioxide for cooling the vessel 30. Some of the liquid sulphur dioxide enters the fluid path which begins inside the vessel 30 and eventually exits said vessel 30 through said fluid output which is a conduit 46. The fluid passes through expansion means, preferably expansion valve 48, and into a contained area in thermal communication with the vessel 30 or its contents. Then the gaseous sulphur dioxide leaves the contained area and passes through compression means described above, and once again into the vessel 30.

More specifically, a certain amount of liquefied sulphur dioxide will enter the output 46 and will eventually pass through valve 38.

Figure 6:
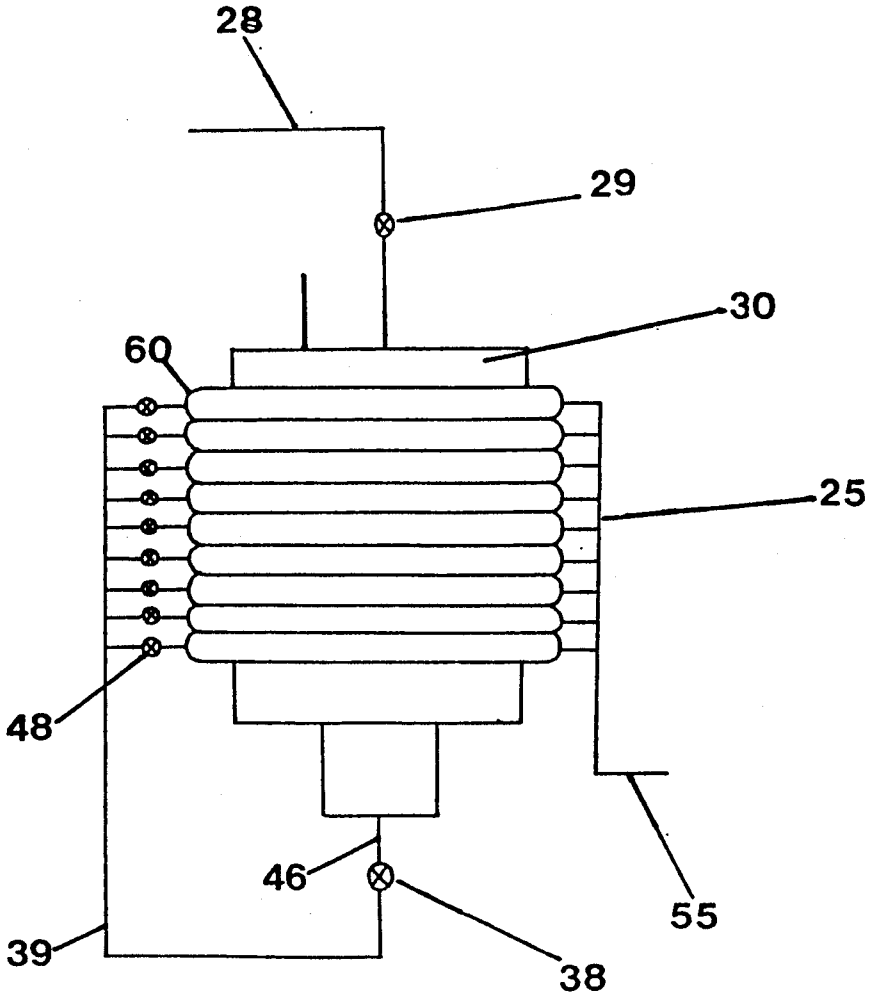
FIG. 6 is a schematic representation of an alternative embodiment of the inventive emissionless furnace apparatus wherein there is a series of expansion valves and jackets around the pressure vessel.
Figure 7:
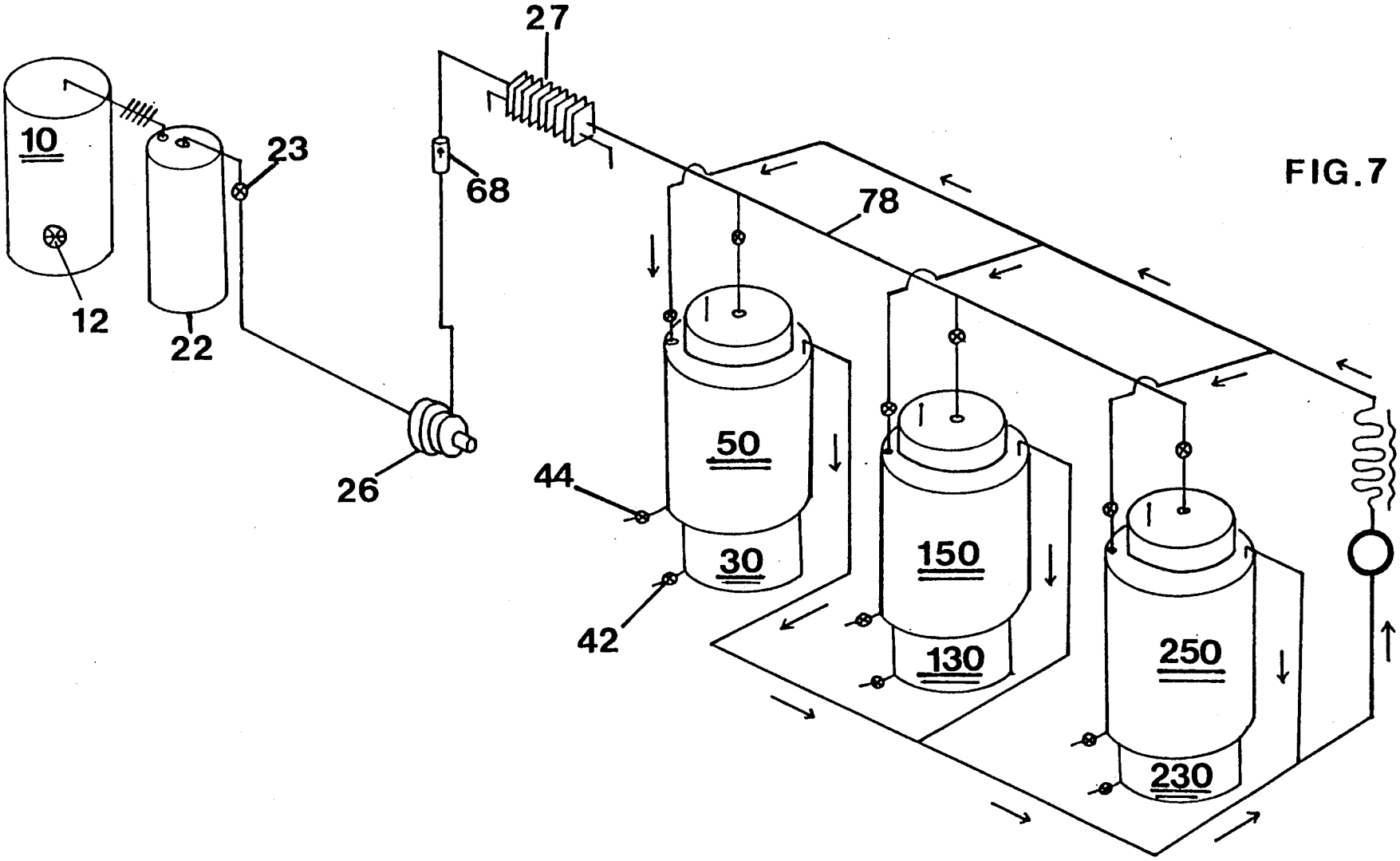
FIG. 7 is a schematic representation of the inventive apparatus including an independent compression apparatus.

From control valve 38, the liquid sulphur dioxide moves through high pressure conduit 39. From this conduit it passes through expansion means in the form of adjustable expansion valve 48 which causes a change-of-state to vapor. This vapor and some liquid enter and pass through a contained volume having the form of an annular jacket 50 which surrounds vessel 30 and is in thermal communication therewith. Alternatively, several separate annular jackets 50 may surround vessel 30. See FIG. 6. The sulphur dioxide, now in the vapor state and at a low pressure, moves through low pressure conduit 25 and 55 which joins low pressure conduit 55 and to compression means in the form of compressor 26. From compressor 26 the sulphur dioxide returns through conduit 28 and condenser 27 to vessel 30 and is again liquefied.

Alternatively, the contained area in the fluid path may be a tubular coil 53. This coil either passes through or around the pressure vessel 30, and its surface is in thermal communication with the pressure vessel 30 or its contents. Then the sulphur dioxide exits this coil 53 and enters low pressure conduit 25, joining conduit 55, and returns to the compressor 26.

Figure 2:
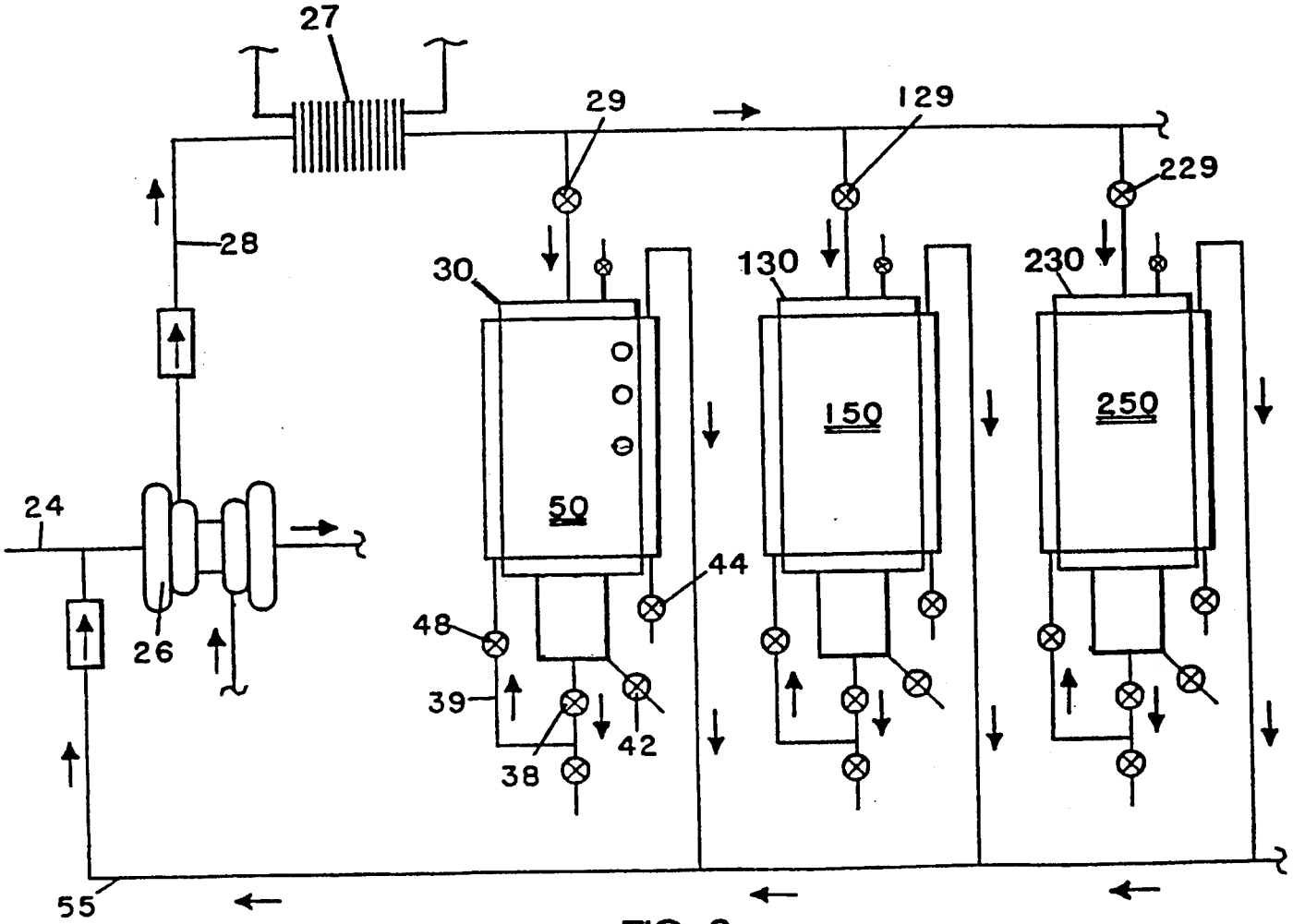
FIG. 2 is a schematic view of the apparatus cooling fluid path.

While the sulphur dioxide liquifies and accumulates within the vessel 30, the higher vapor pressure gases entering the vessel 30 separate into strata above the liquid sulphur dioxide 51. Respective strata levels of the condensed and non-condensed fluids associated with fossil fuel burning appear at the levels of conduits 31, 32 and 33 in FIGS. 1 to 3. These conduits 31, 32 and 33 permit one or more individual fluids to be selectively drained off. More levels of conduits may be provided if more than three non-condensable gases are present.

Alternatively, the stratified fluids are selectively removed, one stratum level at a time, through a conduit in the top of the vessel 30. The conduit contains a gas sensor which closes a valve in the conduit when there is a change in the type of gas entering the conduit. Thus each stratum of gas may be drained-off through the conduit and placed in a separate storage container.

The type of gases forming these strata will vary depending on the fuel burning in the furnace 10. In the burning of coal fuel, for example, the lowest layer of non-condensed gas will be nitrous oxide, the second layer will be carbon dioxide, the top layer will be carbon monoxide. In the case of nitrous oxide, this compound can either be removed from the system for other industrial usages or may be fed back to furnace 10 at return 34 and combusted, thereby enhancing the efficiency of the furnace 10 itself, or the nitrous oxide may be used as a fuel for a gas turbine powered compressor such as compressor 26.

The recovered carbon dioxide may be sold for other industrial uses. Carbon monoxide can be solidified and used in building materials or in landfill or reinjected into the furnace 10.

Several pressure vessels 30, 130, 230 forming a series, shown in FIGS. 1, 2, 3, and 7 and contemplated for use alternatively, so that the recovery apparatus can receive a continuous furnace effluent output. When the effluent gases reach a pre-determined pressure within the first vessel 30, or when condensation is complete, control valve 29 will close and control valve 129 will open, thereby taking vessel 30 out of the circuit, while bringing vessel 130 and jacket 150 into the system. As may be noted in the drawings, any number of vessels of this type may be added to accommodate the effluent gas output of a given facility. It is noted that a spigot 42 is provided in the lower portion of each vessel 30, 130 and 230 to permit drainage of the condensed sulphur dioxide from the pressure vessels. Also provided is a valve 44 which permits the discharge of any contaminants which may accumulate in the lower area of annular jacket 50.

It is to be appreciated that compression means, other than centrifugal compressors, have been proven to be highly cost-efficient devices for the compressing of gases.

Also shown to the right of the furnace 10 is the nitrous oxide return 34 which, in the preferred embodiment, is in fluid communication with conduit 31, above described, which communicates with vessel 30 at the lowest level of accumulated non-condensed gases. Valve 36 provides a control means for the regulation of entry of the nitrous oxide into furnace 10.

Where liquid is input into the furnace 10, a conduit or other closed area may be provided to momentarily contain the liquid and permit it to absorb heat from the heat exchanger 20. A second heat exchanger may be provided between the compressor 26 and the vessel 30, to further cool the gases prior to their entry into vessel 30.

Figure 5:
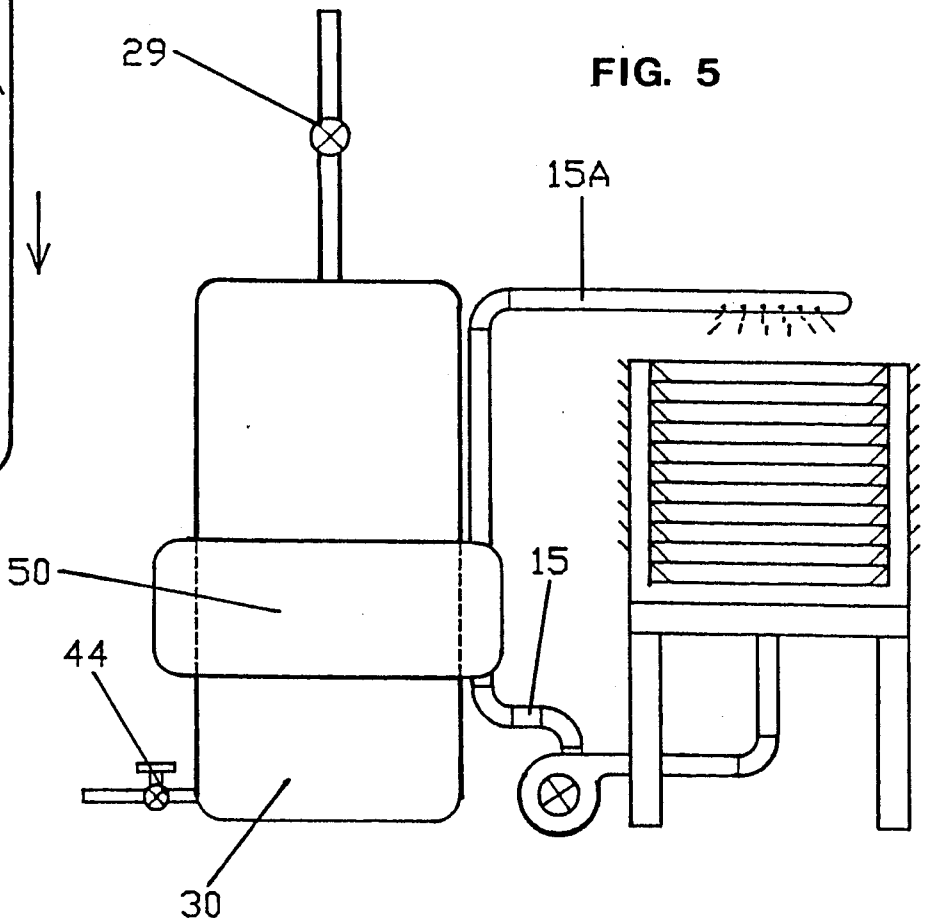
FIG. 5 is a side view of the pressure vessel used as water cooled condenser in conjunction with water tower means.
Figure 4:
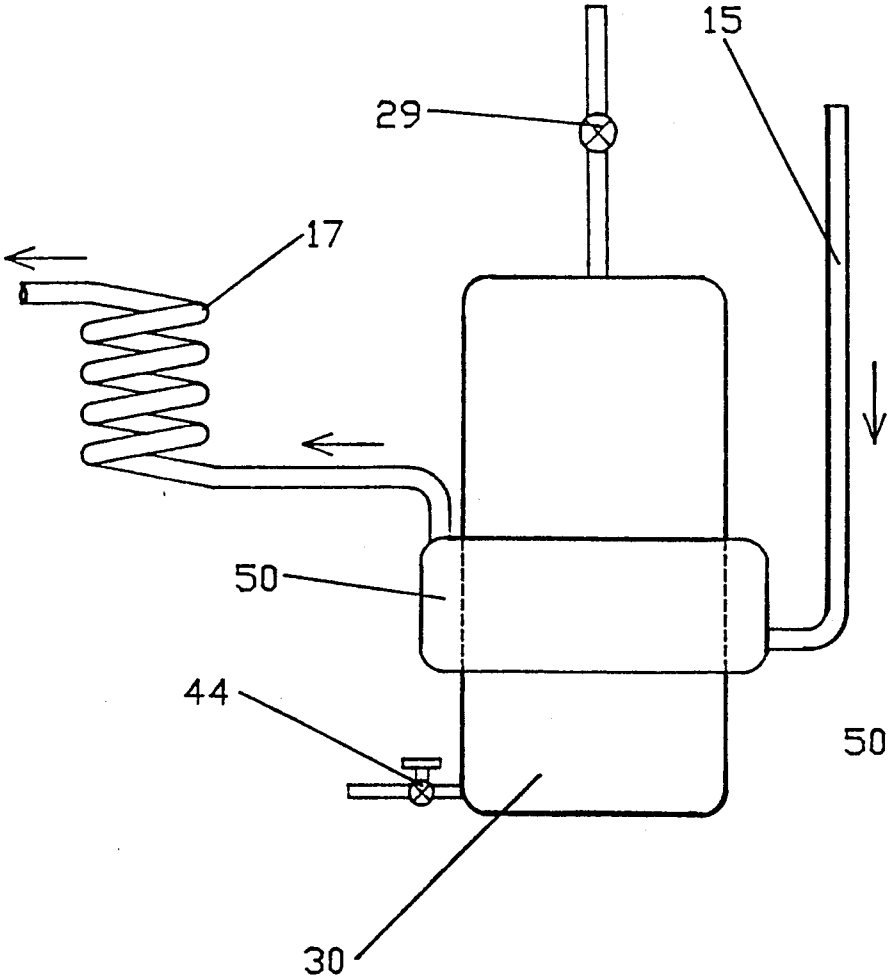
FIG. 4 is a side view of the pressure vessel and jacket showing the cooling fluid path used as a water preheat means for the furnace and its water supply.

In FIGS. 4 and 5 there are shown further embodiments of the present invention employing an alternate or additional annular jacket 60 provided about pressure vessel 30. This alternate jacket 50 is taken out of the refrigeration circuit. Thereby the jacket 60 then may be used as a water cooled condenser. Vessel 30 can then be used to preheat water entering the boiler as demonstrated in FIG. 4. Also when vessel 30 and jacket 50 are being used as a water cooled condenser, water can be circulated through conventional cooling means such as a water tower shown in FIG. 5.

The method of the instant invention for separating and recovering effluent gases from a furnace 10 comprises the steps of adding said gases so that the lowest vapor pressure gas condenses within vessel 30 to a liquid and the remaining non-condensed gases stratifying above said liquid.

The step of altering the density may be done in at least three ways. First, the pressure may be maintained at a constant value above ambient and the temperature lowered until condensation of the lowest vapor pressure gas occurs. Second, the temperature may be maintained at a constant value below ambient and the pressure increased until condensation occurs. Third, the temperature may be lowered while the pressure is raised until condensation occurs.

At least one of the remaining, condensed and non-condensed fluids stratified above the liquid is selectively removed through one or more outlets 31, 32 and 33 in the side of vessel 30. They may also be removed one at a time through a single conduit at the top of the vessel 30. The method may include attempting use of several vessels 30 to separate a continuous stream of effluent gases from a given furnace 10. The number and volume of the vessels is determined by the gravimetric flow rate at which the furnace 10 discharges the effluent gases.

In the preferred embodiment of the invention, the method includes steps of evaporating a portion of the liquid in a contained area in thermal communication with the pressure vessel 30 and its contents to cool the vessel and its contents. It is to be appreciated that this preferred method for cooling the vessel 30 is also a method of distilling, cleaning and purifying the fluid. The method may include filtering the fluid to increase the extent of purification.

The method optionally comprises the step of passing effluent gases through heat exchanger means 20 and/or 27 to cool the gases (See FIG. 1). The heat exchanger means 20 and/or 27 either place the effluent gases in thermal communication with the atmosphere or with liquid input to the furnace 10, prior to the entry of the gases into the vessel 30.

The method also optionally includes controlling the volume of air entering furnace 10 in relation to the pressure of the effluent gases leaving the furnace, so that sufficient oxygen is provided at all times to operate the furnace 10 and a steady pressure is maintained at the entrance to the compression means. Another optional step is to pass the effluent gases through precipitation means prior to their entry into the vessel 30, to remove particulate matter from the gases. Finally, where the pressure of the gases is altered in the steps above with compression means, optional steps are to capture the steam output of the furnace and to power the compression means with the steam.

As an alternative to the apparatus and method illustrated herewith, any apparatus and method for lowering the temperature and raising the pressure of gases and removing same based on differences in stratification levels resulting from such lowering temperature and raising of pressure can be used.

Accordingly, while there has been shown and described the preferred embodiment of the present invention, it is to be understood that the invention may be embodied otherwise than is herein specifically illustrated and described and that, within said embodiment, certain changes in the detail of construction in the form and arrangement of the parts may be made without departing from the underlying idea or principles of this invention within the scope of the claims appended herewith.

Having thus described our invention what I claim as new, useful and non-obvious and, accordingly, secure by Letters Patent of the United States is:

1. An apparatus for separating and recovering effluent fluids from a furnace boiler, comprising:

(a) a pressure vessel for containing effluent gases, having a fluid input for receiving said gases and having a fluid output;

(b) condensing means for transforming and maintaining as a liquid the lowest vapor pressure gas of said effluent gases in which said lowest vapor pressure gas condenses and accumulates as a liquid at the bottom of said vessel and the remaining effluent fluids accumulate in strata above said liquid, according to this vapor pressure;

(c) means for removing said liquid from said vessel, through said fluid output;

(d) means for selectively removing at least one of the remaining effluent fluids from said vessel through said fluid output;

(e) a hollow annular jacket having a surface thereof in thermal communicatin with said pressure vessel, said jacket furthe rhaving a fluid input and a output in fluid communication with said pressure vessel fluid input and output compression means forming part of said condensing means for condensing said lowest vapor pressure gas;

(f) expansion means forming part of said condensing means for increasing the volume of fluid flowing from said vessel into said jacket and for cooling said vessel;

(g) a fluid path for said lowest vapor pressure gas, commencing internally of said pressure vessel, passing through said vessel, externally through said vessel output, to said expansion means, through said jacket, out of said jacket output means and through said compression means, to said vessel fluid input; and (h) means for delivering said effluent gases to said compression means.

2. An apparatus for separating and recovering effluent fluids from a furnace boiler, comprising:

(a) a pressue vessel for containing effluent gases, having a fluid input for receiving said gases and having a fluid output;

(b) condensing means for transforming and maintaining as a liquid the lowest vapor pressure gas of said effluent gases in which said lowest vapor pressure gas condenses and accumulates as a liquid at the bottom of said vessel and the remaining effluent fluids accumulate in strata above said liquid, according to this vapor pressue, said condensing means comprising means for maintaining said lowest vapor pressure and means for lowering the termperature at such pressure to cause condensation of said lowest vapor pressure gas;

(c) means for removing said liquid from said vessel, through said fluid output;

(d) means for selectively removing at least one of the remaining effluent fluids from said vessel through said fluid output;

(e) a hollow annular jacket having a surface thereof in thermal communication with said pressure vessel, said jacket further having a fluid input and a output in fluid communciation with said pressure vessel fluid input and output compression means forming part of said condensing means for condensing said lowest vapor pressure gas;

(f) expansion means forming part of said condensing means for increasing the volume of fluid flowing from said vessel into said jacket and for cooling said vessel;

(g) a fluid path for said lowest vapor pressure gas, commensing internally of said pressure vessel, passing through said vessel, externally through said vessel output, to said expansion means, through said jacket, out of said jacket output means and through said compression means, to said vessel fluid input; and (h) means for delivering said effluent gases to said compression means.

3. An apparatus for separating and recovering effluent fluids from a furnace boiler, comprising:

(a) a pressue vessel for containing effluent gases, having a fluid input form receiving said gases and having a fluid output;

(b) condensing means for transforming and maintaining as a liquid the lowest vapor pressure gas of said effluent gases in which said lowest vapor pressure gas condenses and accumulates as a liquid at the bottom of said vessel and the remaining effluent fluids accumulate in strata above said liquid, according to this vapor pressure, said condensing means comprising means for maintaining temperature within said vessel and further comprising means for increasing said pressure at said termperature of the gases to a level above the vapoor pressure of the lowest vapor pressure gas to cause condensation of said lowest vapor pressure gas;

(c) means for removing said liquid from said vessel, through said fluid output;

(d) means for selectively removing at least one of the remaining effluent fluids from said vessel through said fluid output;

(e) a hollow annular jacket having a surface thereof in thermal communication with said pressure vessel, said jacket further having a fluid input and a output in fluid communication with said pressure vessel fluid input and output compression means forming part of said condensing means for condensing said lowest vapor gas;

(f) expansion means forming part of said condensing means for increasing the volume of fluid flowing from said vessel into said jacket and for cooling said vessel;

(g) a fluid path for said lowest vapor pressure gas, commencing internally of said pressure vessel, passing through said vessel, externally through said vessel output, to said expansion means, through said jacket, out of said jacket output means and through said compression means, to said vessel fluid input; and (h) means for delivering said effluent gases to said compression means.

4. An apparatus for separating and recovering effluent fluids froma furnace boiler, comprising:

(a) a pressure vessel for containing effluent gases, having a fluid input for receiving said gases and having a fluid output;

(b) condensing means for transforming and maintaining as a liquid the lowest vapor pressure gas of said effluent gases in which said lowest vapor pressure gas condenses and accumulates as a liquid at the bottom of said vessel and the remaining effluent fluids accumulate in strata above said liquid, according to this vapor pressure, said condensing means comprising means for increasing said lowest vapor pressure and decreasing the temperature of the gas within said vessel to cause condensation of said lowest vapor pressue gas;

(c) means for removing said liquid from said vessel, through said fluid output;

(d) means for selectively removing at least one of the remaining effluent fluidws from said vessel through said fluid output;

(e) a hollow annular jacket having a surface thereof in thermal communication with said pressure vessel, said jacket further having a fluid input and a output in fluid communication with said pressure vessel fluid input and output compression means forming part of said condensing means for condensing said lowest vapor pressure gas;

(f) expansion means forming part of said condensing means for increasing the volume of fluid flowing from said vessel into said jacket and for cooling said vessel;

(g) a fluid path for said lowest vapor pressure gas, commencing internally of said pressure vessel, passing through said vessel, externally through said vessel output, to said expansion means, through said jacket, out of said jacket output means and through said compression means, to said vessel fluid input; and (h) means for delivering said effluent gases to said compression means.

5. An apparatus for separating and recovering effluent fluids from a furnace boiler, comprising:

(a) a pressure vessel for containing effluent gases, having a fluid input for receiving said gases and having a fluid output;

(b) condensing means for transforming and maintaining as a liquid the lowest vapor pressure gas of said effluent gases in which said lowest vapor pressure gas condenses and accumulates as a liquid at the bottom of said vessel and the remaining effluent fluids accumulate in strata above said liquid, according to this vapor pressure;

(c) means for removing said liquid from said vessel, through said fluid output;

(d) means for selectively removing at least one of the remaining effluent fluids from said vessel through said fluid output;

(e) a tubular partition in thermal communication with said pressue vessel, said partition further having a fluid input and output, said partition in fluid communication with said pressure vessel fluid input and output;

(f) compression means forming part of said condensing means for condensing said lowest vapor pressure gas, and expansion means forming part of said condensing means for increasing the volume of fluid flowing from said vessel into said tubular partition for cooling said vessel;

(g) a fluid path for said lowest vapor pressure gas, commencing internally of said pressure vessel, passing thought said vessel, through said vessel output means, to expansion means into said tubular partition input and through said partition for cooling said vessel, out of said partition output and through compression means, to said vessel fluid input; and (h) means for delivering furnace boiler effluent gases to said compression means.

6. An apparatus for separating and recovering effluent fluids from a furnace boiler, comprising:

(a) a pressure vessel for containing effluent gases, having a fluid input for receiving said gases and having a fluid output;

(a) a pressure vessel for containing effluent gases, having a fluid input for receivng said gases and having a fluid output;

(b) condensing means for transforming and maintaining as a liquid the lowest vapor pressure gas of said effluent gases in which said lowest vapor pressure gas condesnses and accumultes as a liquid at the bottom of said vessel and the remaining effluent fluids accumulate in strata above said liquid, according to this vapor pressure, said condensing means comprising means for maintaining said lowest vapor pressue and further comprises means for lowering the temperature at such pressure to thereby cause condensationof said lowest vapor pressure gas;

(c) means for removing said liquid from said vessel, through said fluid output;

(d) means for selectively removing at least one of the remaining effluent fluids from said vessel through said fluid output;

(e) a tubular partition in thermal communication with said pressure vessel, said partition further having a fluid input and output, said partition in fluid communication with said pressure vessel fluid input and output;

(f) compression means forming part of said condensing means for condensing said lowest vapor pressure gas, and expansion means forming part of said condensing means for increasing the volume of fluid flowing from said vessel into said tubular partition for cooling said vessel;

(g) a fluid path for said lowset vapor pressure gas, commencing internally of said pressure vessel, passing though said vessel, through said vessel output means, to expansion means to expansion means into said tubular partition input and through said partition for cooling said vessel, out of said partition output and through compression means, to said vessel fluid input; and (h) means for delivering furnace boiler effluent gases to said compression means.

7. An apparatus for separating and recovering effluent fluids from a furnace boiler, comprising:

(a) a pressure vessel for containing effluent gases, having a fluid input for receiving said gases and having a fluid output;

(b) condensing means for transforming and maintaining as a liquid the lowest vapoor pressure gas of said effluent gases in which said lowest vapor pressure gas condenses and accumulates as a liquid at the bottom of said vessel and the remaining effluent fluids accumulate in strata above said liquid, according to this vapoor pressure, said condensing means comprising means for maintaining a temperature within said vessel and further comprising means for increasing said lowest vapor pressure at said temperature of the gases to a level above the vapor pressure at the lowest vapor pressure gas to thereby cause condensation of said lowest vapor pressure gas;

(c) means for removing said liquid from said vessel, through said fluid output;

(d) means for selectively removing at least one of the remaining effluent fluids from said vessel through said fluid output;

(e) a tubular partition in thermal communication with said pressure vessel, said partition further having a fluid input and output, said partition in fluid communication with said pressure vessel fluid input and output;

(f) compresssion means forming part of said condensing means for condensing said lowest vapor pressure gas, and expansion means forming part of said condensing means for increasing the volume of fluid flowing from said vessel into said tubular partition for cooling said vessel;

(e) a fluid path for said lowset vapor pressure gas, commencing internally of said pressure vessel, passing thought said vessel, through said vessel output means, to expansion means into said tubular partition input and through said partition for cooling said vessel, out of said partition output and through compression means, to aid vessel fluid input; and (h) means for delivering furnace boiler effluent gases to said compression means.

8. An apparatus for separating and recovering effluent fluids from a furnace boiler, comprising:

(a) a pressure vessel for containing effluent gases, having a fluid input for receiving said gases and having a fluid output;

(b) condensing means for transforming and maintaining as a liquid the lowest vapor pressue gas of said effluent gases in which said lowest vapor pressure gas condenses and accumulates as a liquid at the bottom of said vessel and the remaining effluent fluids accumulate in strata above said liquid, according to this vapor pressure, said condensing mean comprising means for increasing said lowest vapor pressure and means for decreasing the temperature of the gases within said vessel to thereby cause condensation of said lowest vapor pressure gas;

(c) means for removing said liquid from said vessel, through said fluid output;

(d) means for selectively removing at least one of the remaining effluent fluids from said vessel through said fluid output;

(e) a tubular partition in thermal communication with said pressure vessel, said partition further having a fluid input and output, said partition in fluid communication with said pressure vessel fluid input and output;

(f) compression means forming part of said condensing means for condensing said lowest vapor pressure gas, and expansion means forming part of said condensing means for increasing the volume of fluid flowing fromsaid vessel into said tubular partition for cooling said vessel;

(g) a fluid path for said lowest vapor pressure gas, commencing internally of said pressure vessel, passing thought said vessel, through said vessel output means, to expansion means into said tubular partition input and through said partition for cooling said vessel, out of said partition output and through compression means, to said vessel fluid inptu; and (h) means for delivering furnace boiler effluent gases to said compression means.

9. A method for recovering effluent gases from a furnace boiler, comprising the steps of:

(a) adding said gases to a pressure vessel;

(b) altering the pressure and temperature of the gases so that the lowest vapor pressure gas condenses within said vessel to a liquid and the remaining non-condensed gases stratify above according to their specific gravities;

(c) removing said liquid from said vessel;

(d) selectively removing at least one stratified, non-condensed gas remaining in said vessel through an outlet of said vessel; and (e) passing a portion of said liquid into a partition in thermal communication with said pressure vessel, and evaporating said liquid to cool said vessel and its contents.

10. A method for recovering effluent gases from a furnace boiler, comprising the steps of:

(a) adding said gases to a pressure vessel;

(b) altering the pressure and temperature of the gases so that the lowest vapor pressure gas condenses within said vessel to a liquid and the remaining non-condensed gases stratify above said liquid;

(c) removing said liquid from said vessel;

(d) selectively removing at least one stratified, non-condensed gas remaining in said vessel through an outlet of said vesself and (e) passing a portion of said liquid into multiple discete partitions in thermal communication with said pressure vessel, and evaporating said liquid to cool the vessel and its contents.

11. A method for recovering effluent gases from a furnace boiler, comprising the steps of:

(a) adding said gases to a presssure vessel;

(b) altering the pressure and temperature of the gases so that the lowest vapor pressure gas condenses within said vessel to a liquid and the remaining non-condensed gases stratify above said liquid;

(c) removing said liquid from said vessel;

(d) selectively removing at least one stratified, non-condensed gas remaining in said vessel through an outlet of said vessel; and (e) passing the effluent gases through precipitation means prior to their entry into said pressure vessel to remove particulate matter from said gases.

12. A method for recovering effluent gases from a furnace boiler, comprising the steps of:

(a) adding said gases to a pressure vessel;

(b) altering the pressure and temperature of the gases so that the lowest vapor pressure gas condenses within said vessel to a liquid and the remaining non-condensed gases stratify above said liquid;

(c) removing said liquid from said vessel; and (d) selectively removing at least one stratified, non-condensed gas remaining in said vessel through an outlet of said vessel;

(e) altering pressure of the effluent gasses by passing the gasses through impression means to their entry into the pressure vessel;

(f) capturing the steam output of said furnace boiler; and (g) powering said gas compression means with said steam.

13. The method of claim 9 in which said adding Step (a) comprises use of a plurality of pressure vessels, connected in parallel, to accommondate an extended capacity of effluent gases.

14. A method for recovering effluent gases from a furnace boiler, comprising the steps of:

(a) adding said gases to a plurality of pressure vessels, connected a series, to accommondat a continuous stream of effluent gases;

(b) altering the pressure and temperature of the gases in the respective vessels so that the lowest vapor pressure gases condenses in each vessel to a liquid and the remaining non-condensed gases stratify above said liquid within each vessel;

(c) removing said liquid from said vessel;

(d) selectively removing at least one stratify non-condensed gas remaining in each of said vessels through an outlet therefrom; and (e) determining the number and volume of said pressure vessels by the rate of release of the gases therein.

15. The apparatus as recited in claim 1, 2, 3 or 4 further comprising:

means for selectably exhausting and storing various strata of condensed and non-conedensed fluid accumulated within said pressure vessel above the condensed lowest vapor pressure effluent gas.

16. The apparatus of Claim 1, 2, 3 or 4 further comprising:

heat exchanger means for placing said effluent gases in thermal communication with the atmosphere to lower the temperature of said gases.

17. The apparatus of claim 5, 6, 7 or 8 further comprising:

heat exchanger means for placing said effluent gases in thermal communication with the atmosphere to lower the temperature of said gases.

18. The apparatus as recited in claim 1, 2, 3 or 4, further comprising:

a liquid input to said furnace boiler comprising heat exchanger means in thermal communication with said output of said furnace boiler.

19. The apparatus as recited in claim 5, 6, 7 ir 8 further comprising:

a liquid input to said furnace boiler comprising heat exchanger means in thermal communication with said output of said furnace boiler.

20. The apparatus of claim 1, 2, 3 or 4, further comprising:

an air input means to said furnace; and control means for said air input means responsive to pressure of fluid entering said compression means and to the oxygen content of the furnace to thereby maintain a steady entrance pressure at said compression means and a designated oxygen content for the furnace.

21. The apparatus of claim 5, 6, 7 or 8, further comprising:

an air input means to said furnace; and control means for said air input means responsive to pressure of fluid entering said compression means and to the oxygen content of the furnace to maintain a steady entrance pressure at said compression means and a designated oxygen content for the furnace.

22. The apparatus of claim 1, 2, 3 or 4, further comprising:

means for accumulating said effluent gases to provide a steady entrance pressure for the compression means.

23. The apparatus of claim 5, 6, 7 or 8, further comprising:

means for accumulating said effluent gases to provide a steady entrance pressure for the compression means.

24. The apparatus of claim 1, 2, 3 or 4, further comprising:

a precipitator in said fluid path to remove particulate matter from said gases.

25. The apparatus of claim 5, 6, 7 or 8, further comprising:

a precipitator in said fluid path to remove particulate matter form said gases.

26. The apparatus of claim 1, 2, 3 oor 4, further comprising:

a steam output of said furnace and means for steam powering said compression means employing steam output.

27. The apparatus of claim 5, 6, 7 or 8, futher comprising:

a steam output of said furnace and means for steam powering said compression means employing said steam output.

28. The apparatus of claim 22, further comprising:

a damper and related damper control means for regulating fluid flow between said accumulating means and said compression means.

29. The aparatus of claim 23, further comprising:

a damper and related damper control means for regulating fluid flow between said accumulation means and said compression means.

30. The apparatus as recited in claim 1, 2, 3 or 4, further comprising:

thermodynamic partition means in thermal communication with said fluid input means to said furnace boiler and in fluid communication with said pressure vessel.

31. The apparatus of claim 5, 6, 7 or 8 in which the fluid path after said compresssion means further comprises:

coil means in thermal communication with said pressure vessel, and in communication with said vessel through said vessel fluid input.

32. The method of claim 9, comprising the additional steps of:

supplying liquid input to the furnace; and passing said effluent gases through heat exchanger means in thermal communication with the liquid input of said furnace, prior to the entry of said gases into said compression means.

33. The method of claim 32, comprising the additional steps of:

altering the pressure of the effluent gases by passing the gases through compression means prior to their entry into the pressure vessel;

providing air to said furnace; and controlling the volume of air entering the furnace in relation to the pressure of the effluent gases leaving the furnace, so that sufficient oxygen is provided at all times to operate the furnace and a steady pressure is maintained at the entrance to said compression means.

34. The method of claim 33, further comprising removing any nitrous oxide from the pressure vessel and adding the same to the furnace.

* * * * *